US010358872B2

(12) United States Patent
Rossing et al.

(10) Patent No.: US 10,358,872 B2
(45) Date of Patent: Jul. 23, 2019

(54) DRILLING TOOL WITH NON-SYNCHRONOUS OSCILLATORS AND METHOD OF USING SAME

(71) Applicant: NATIONAL OILWELL DHT, L.P., Conroe, TX (US)

(72) Inventors: Mike Rossing, Spring, TX (US); Avinash Hariprasad Cuddapah, Pearland, TX (US)

(73) Assignee: National Oilwell DHT, L.P., Houston, TX (US)

( * ) Notice: Subject to any disclaimer, the term of this patent is extended or adjusted under 35 U.S.C. 154(b) by 0 days.

(21) Appl. No.: 16/130,557

(22) Filed: Sep. 13, 2018

(65) Prior Publication Data

US 2019/0010762 A1 Jan. 10, 2019

Related U.S. Application Data

(63) Continuation of application No. PCT/US2017/044956, filed on Aug. 1, 2017.

(60) Provisional application No. 62/369,878, filed on Aug. 2, 2016.

(51) Int. Cl.

| | |
|---|---|
| ***E21B 7/24*** | (2006.01) |
| ***E21B 28/00*** | (2006.01) |
| ***E21B 43/12*** | (2006.01) |

(52) U.S. Cl.

CPC ..... *E21B 7/24* (2013.01); *E21B 28/00* (2013.01); *E21B 43/126* (2013.01)

(58) Field of Classification Search

CPC ... E21B 1/00; E21B 4/14; E21B 28/00; E21B 31/005; E21B 43/003

See application file for complete search history.

(56) References Cited

U.S. PATENT DOCUMENTS

| | | | | |
|---|---|---|---|---|
| 7,401,656 | B2 | 7/2008 | Wood et al. | |
| 7,405,998 | B2 * | 7/2008 | Webb | E21B 7/18 166/104 |
| 2005/0269097 | A1 * | 12/2005 | Towler | E21B 28/00 166/308.1 |
| 2007/0125552 | A1 * | 6/2007 | Wood | E21B 7/02 166/385 |

(Continued)

FOREIGN PATENT DOCUMENTS

| | | | |
|---|---|---|---|
| CN | 203403820 | U | 1/2014 |
| CN | 105332655 | A | 2/2016 |
| WO | 2012/138383 | A2 | 10/2012 |

OTHER PUBLICATIONS

International Search Report and Written Opinion dated Oct. 20, 2017, for International Application No. PCT/US2017/044956.

(Continued)

*Primary Examiner* — Jennifer H Gay
(74) *Attorney, Agent, or Firm* — Conley Rose, P.C.

(57) ABSTRACT

Apparatus and method for drilling a wellbore using non-synchronous oscillators. An apparatus for drilling a wellbore includes a tubing string and a bottom hole assembly coupled to the tubing string. The bottom hole assembly includes a first oscillator and a second oscillator. The first oscillator is configured to restrict fluid flow and induce pressure pulses in the tubing string at a first frequency. The second oscillator is configured to restrict fluid flow and induce pressure pulses in the tubing string at a second frequency. The first frequency is different from the second frequency.

24 Claims, 12 Drawing Sheets

(56) References Cited

U.S. PATENT DOCUMENTS

2010/0230113 A1* 9/2010 Hutin ..... E21B 47/182 166/373
2012/0160476 A1* 6/2012 Bakken ..... E21B 31/005 166/177.6
2012/0167994 A1* 7/2012 Schultz ..... E21B 28/00 137/12
2012/0168013 A1* 7/2012 Schultz ..... E21B 28/00 137/599.01
2012/0193145 A1* 8/2012 Anderson ..... E21B 7/24 175/56
2013/0048274 A1* 2/2013 Schultz ..... E21B 28/00 166/244.1
2013/0048379 A1 2/2013 MacDonald et al.
2014/0083689 A1* 3/2014 Streich ..... E21B 34/063 166/250.15
2014/0126330 A1* 5/2014 Shampine ..... E21B 47/0006 367/82
2014/0196905 A1* 7/2014 Schultz ..... E21B 28/00 166/319
2014/0246234 A1* 9/2014 Gillis ..... E21B 7/24 175/24
2015/0218911 A1* 8/2015 Abramova ..... E21B 37/00 166/177.1
2016/0053547 A1* 2/2016 Samuel ..... E21B 10/00 175/57
2017/0152720 A1* 6/2017 Greenwood ..... E21B 7/24
2017/0226806 A1* 8/2017 Nguyen ..... E21B 7/24
2017/0284195 A1* 10/2017 White ..... E21B 47/182
2018/0128093 A1* 5/2018 Jeffryes ..... E21B 45/00
2018/0291733 A1* 10/2018 Ritchie ..... E21B 47/187

OTHER PUBLICATIONS

Extended European Search Report dated Feb. 14, 2019, for Application No. EP 17837563.0.

* cited by examiner

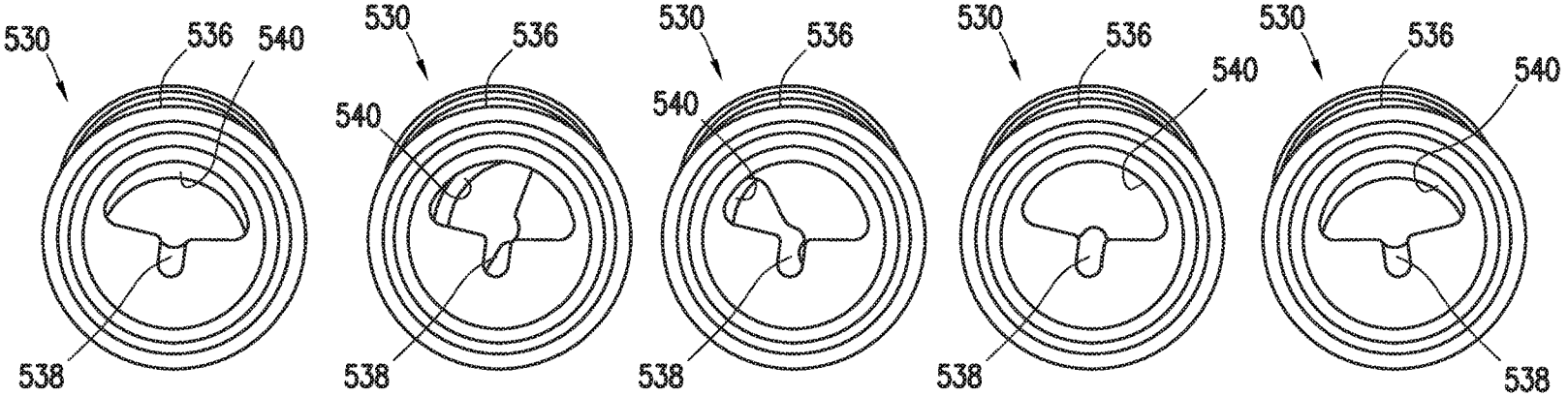
FIG. 5A
FIG. 5B
FIG. 5C
FIG. 5D
FIG. 5E
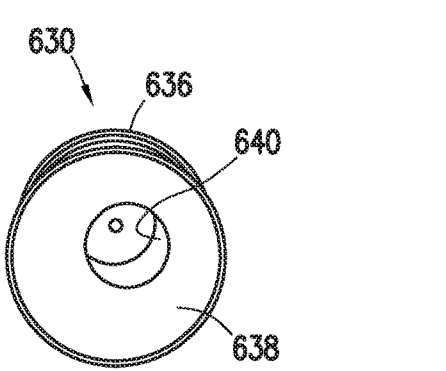
FIG. 6A
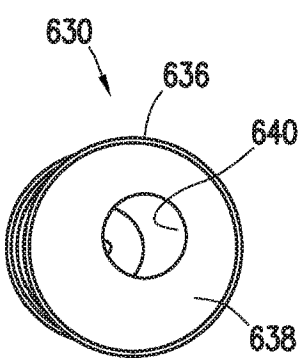
FIG. 6B
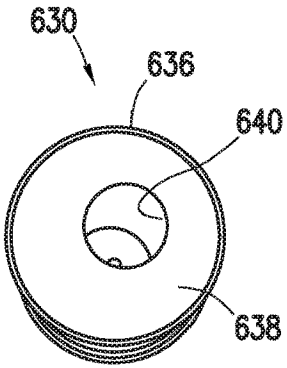
FIG. 6C
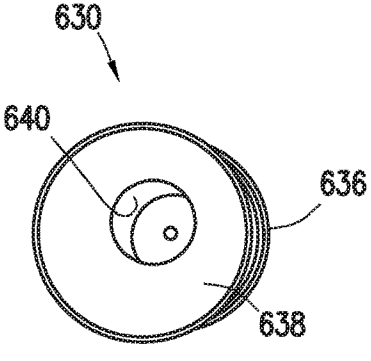
FIG. 6D

FREQ 1 > FREQ 2 (OR FREQ 1 < FREQ 2)

DRILLING TOOL WITH NON-SYNCHRONOUS OSCILLATORS AND METHOD OF USING SAME

CROSS-REFERENCE TO RELATED APPLICATIONS

The present application is a continuation of International Application No. PCT/US2017/044956 filed Aug. 1, 2017, and entitled "Drilling Tool With Non-Synchronous Oscillators and Method of Using Same," which claims benefit of U.S. provisional patent application Ser. No. 62/369,878, filed Aug. 2, 2016, and entitled "Drilling Tool With Non-Synchronous Oscillators and Method of Using Same," both of which are hereby incorporated herein by reference in their entirety.

BACKGROUND

The present disclosure relates generally to techniques for performing wellsite operations. More specifically, the present disclosure relates to operation of wellsite equipment, such as drilling devices.

Oilfield operations may be performed to locate and gather valuable subsurface fluids. Oil rigs are positioned at wellsites, and subsurface equipment, such as a drilling tool, is advanced into the ground to reach subsurface reservoirs. The drilling tool includes a conveyance, a bottomhole assembly ("BHA"), and a drill bit. The drill bit is mounted on the subsurface end of the BHA, and advanced into the earth by the conveyance (e.g., drill string or coiled tubing) to form a wellbore. The oil rig is provided with various surface equipment, such as a top drive, a Kelly and a rotating table, used to threadedly connect the stands of pipe together to extend the drill string and advance the drill bit. Downhole drilling tools may be deployed into a wellbore via coiled tubing to drill or clean the wellbore.

The BHA of the drilling tool may be provided with various drilling components to perform various subsurface operations, such as providing power to the drill bit to drill the wellbore and performing subsurface measurements. Examples of drilling components are provided in U.S. patent application Ser. No. 13/954,793, 2009/0223676, 2011/0031020, 2012/0186878, U.S. Pat. Nos. 7,419,018, 6,508,317, 6,431,294, 6,279,670, and 4,428,443, and PCT Application NO. WO2014/089457, the entire contents of which are hereby incorporate by reference herein.

In some cases, downhole tools, such as the drilling tools, may have difficulty passing through the wellbore and/or may become stuck in the wellbore. Techniques are needed to facilitate movement of the downhole tools.

SUMMARY

Apparatus and methods for drilling a wellbore using non-synchronous oscillators are disclosed herein. In one embodiment, an apparatus for drilling a wellbore includes a tubing string and a bottom hole assembly coupled to the tubing string. The bottom hole assembly includes a first oscillator and a second oscillator. The first oscillator is configured to restrict fluid flow and induce pressure pulses in the tubing string at a first frequency. The second oscillator is configured to restrict fluid flow and induce pressure pulses in the tubing string at a second frequency. The first frequency is different from the second frequency.

In another embodiment, a method for drilling a wellbore includes arranging a first oscillator and a second oscillator in a bottom hole assembly. The method also includes positioning the bottom hole assembly in the wellbore via a tubing string coupled to the bottom hole assembly. The method further includes inducing pressure pulses of a first frequency in the tubing string by operating the first oscillator. The method yet further includes inducing pressure pulses of a second frequency in the tubing string by operating the second oscillator. The first frequency is different from the second frequency.

In a further embodiment, an oscillation assembly for use in drilling a wellbore includes a first oscillator, a second oscillator, and a rotor. The first oscillator is configured to restrict fluid flow in a tubing string at a first frequency. The first oscillator includes a first valve configured to open and close to restrict the fluid flow in the tubing string at the first frequency. The second oscillator is configured to restrict fluid flow in the tubing string at a second frequency. The second oscillator includes a second valve configured to open and close to restrict the fluid flow in the tubing string at the second frequency. The rotor is coupled to the first valve and the second valve to induce opening and closing of the first valve at the first frequency and the second valve at the second frequency. The first frequency is different from the second frequency.

BRIEF DESCRIPTION OF THE DRAWINGS

A more particular description of the disclosure, briefly summarized above, may be had by reference to the embodiments thereof that are illustrated in the appended drawings. It is to be noted, however, that the appended drawings illustrate examples and are, therefore, not to be considered limiting of its scope. The figures are not necessarily to scale and certain features, and certain views of the figures may be shown exaggerated in scale or in schematic in the interest of clarity and conciseness.

FIGS. 5A-8D are various horizontal cross-sectional views of various valves usable with the oscillation assemblies.

DETAILED DESCRIPTION

The description that follows includes exemplary apparatus, methods, techniques, and/or instruction sequences that embody techniques of the present subject matter. However, it is understood that the described embodiments may be practiced without these specific details.

A downhole tool is provided with an oscillation assembly to induce movement in the tool. The oscillation assembly includes one or more oscillators including drive assemblies to activate valves to vary flow through the tool. The valves are operated to generate synchronous and/or non-synchronous frequencies to generate pressure pulses that cause movement, such as extension, retraction, and/or oscillations, in the downhole tool.

Oscillations as used herein refers to movement, such as vibration, reciprocation, and/or other repetitive movement generated about the downhole tool in a direction along an axis of the tool which may be used to apply compressive and tensile forces to the downhole tool. Synchronous refers to the simultaneous movement of the oscillators (e.g., at the same frequencies). Non-synchronous refers to the irregular (non-simultaneous) movement of the oscillators (e.g., at different frequencies). Non-synchronous oscillation may be generated such that the frequency of the pressure pulses and their harmonics move in and out of phase, move into and/or out of sequence, and/or sweep through a frequency range.

Oscillation may be used to facilitate movement of the downhole tool (e.g., the drill string, BHA, bit, and/or other portions of the work string) about the wellbore, to reduce friction along the downhole tool, to facilitate drilling, to prevent buckling of conveyances (e.g., drill string, coiled tubing, etc.), to reduce friction, to facilitate fishing, and/or to advance further into the wellbore.

The oscillations may be manipulated to provide frequencies (and/or multiples of frequencies) tailored to individually and/or separately provide frequencies to generated movement intended to address downhole issues, such as buckling (e.g., sinusoidal and/or helical collapse of the conveyance) and/or sticking (e.g., attaching to mud and/or wellbore, and/or stuck in wellbore pockets and/or deviations).

Figure 1A:
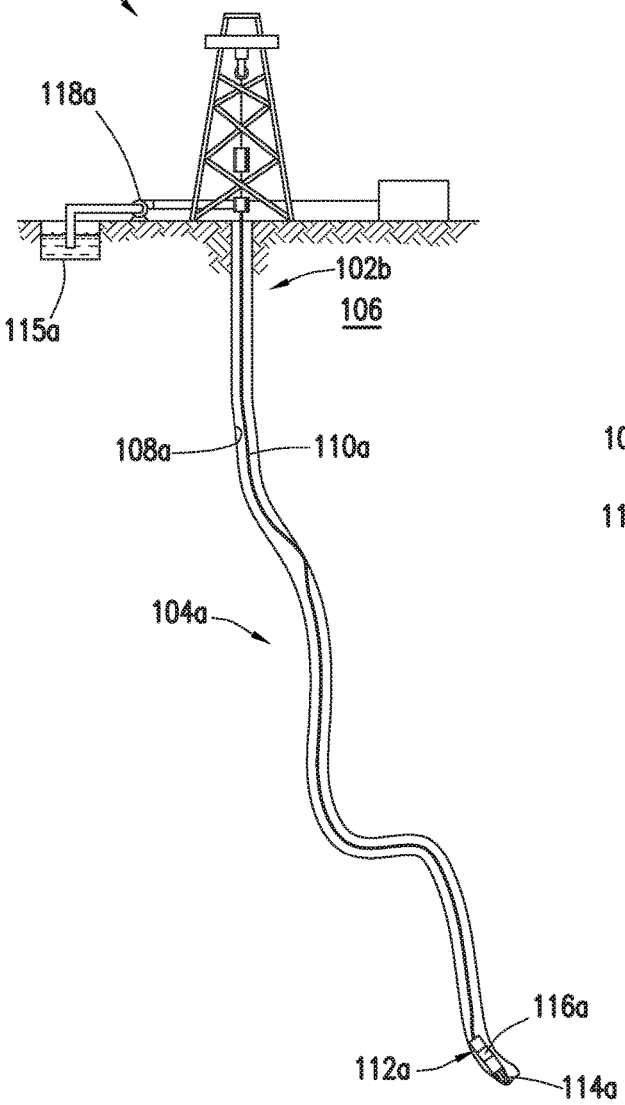
FIGS. 1A-1D are schematic diagrams of wellsites with various downhole tools deployed into a wellbore, the downhole tools comprising non-synchronous oscillation assemblies.
Figure 1B:
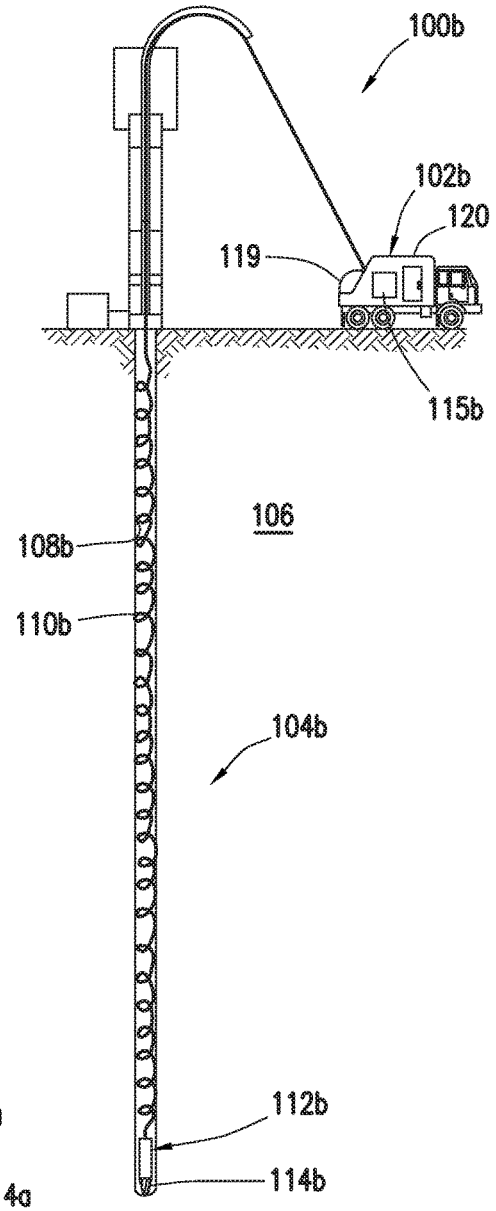
Figure 1C:
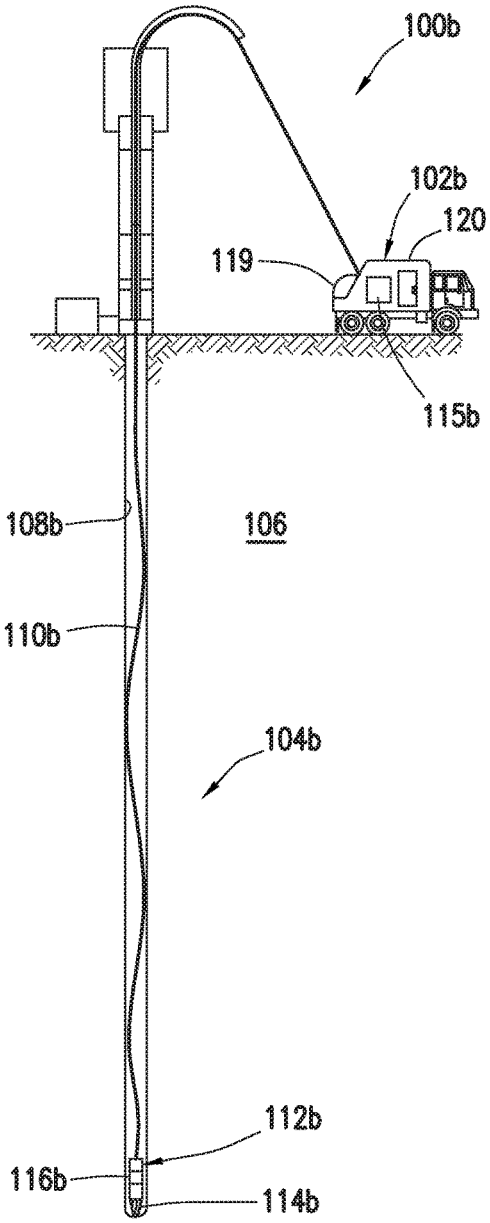
Figure 1D:
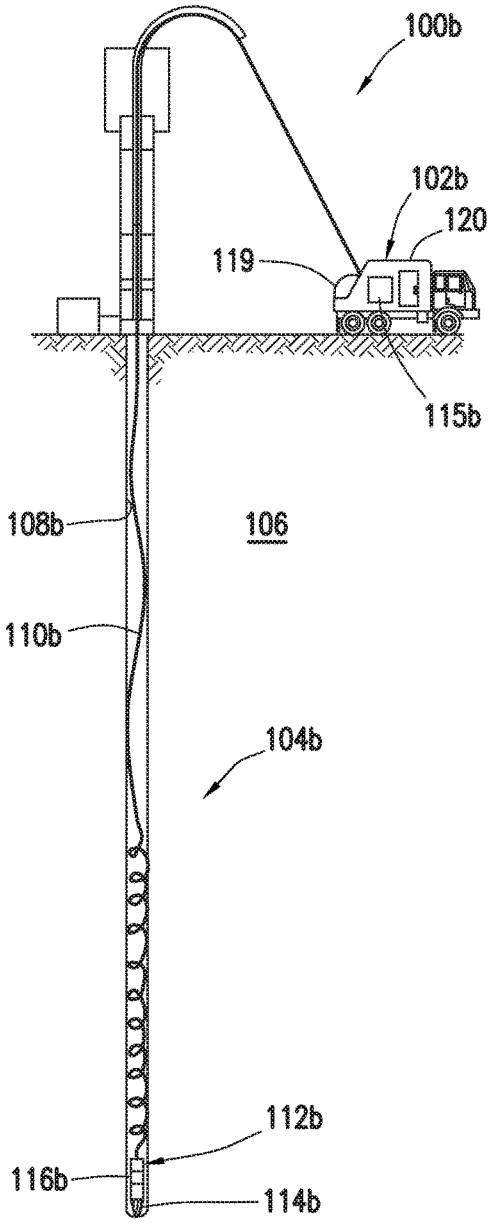

FIGS. 1A-1D depict land-based wellsites 100*a-b*. FIG. 1A shows the wellsite 100*a* during drilling with a downhole drilling tool 104*a*. FIGS. 1B-1D show the wellsite 100*b* during drilling with a downhole coiled tubing ("CT") tool 104*b*. While a land-based wellsite is depicted, the wellsite may be offshore. Also while linear and curved wellbores are shown at the wellsite, a variety of wellbore configurations may be present.

The wellsite 100*a* of FIG. 1A has a drilling rig 102*a* with the downhole drilling tool 104*a* advanced into a subterranean formation 106 to form a wellbore 108*a*. As shown, the wellbore 108*a* is curved, but may be any shape. Geometry of the wellbore may define curves, deviations, variations in shape, and/or obstructions that may interfere with the passage of the downhole tool.

The downhole drilling tool 104*a* includes a drill string (conveyance) 110*a*, a BHA 112*a*, and a drill bit 114*a* at a downhole end thereof. The wellsite 100*a* also has a mud pit 115*a* and a pump 118*a* for pumping mud through the drill string 110*a* and the BHA 112*a*. The mud is pumped out the drill bit 114*a* and back to the surface in an annulus between the downhole drilling tool 104*a* and a wall of the wellbore 108*a*.

The BHA 112*a* may include various drilling components, such as motors, measurement while drilling ("MWD"), logging while drilling ("LWD"), telemetry, and other drilling tools, to perform various subsurface operations. The BHA 112*a* also includes a non-synchronous oscillation (and/or vibration) assembly 116*a* for oscillating the downhole drilling tool 104*a* as is described further herein.

The wellsites 100*b* of FIGS. 1B-1D each show a CT unit 102*b* positioned above a wellbore 108*b* and a CT reel 119 carried by a truck 120. As shown, the wellbore 108*b* is vertical, but may be any shape. The downhole CT tool 104*b* is deployed into the wellbore 108*b* via a CT 110*b*. During deployment, the CT 110*b* may form a helical coil as shown in FIG. 1B or a sinusoidal coil as shown in FIG. 1C. In at least some cases, the downhole CT tool 104*b* is pushed through the wellbore 108*b*. The downhole CT tool 104*b* may lack rigidity resulting in sinusoidal and/or helical buckling as shown.

The CT tool 104*b* includes the CT (conveyance) 110*b*, a BHA 112*b*, and a drill bit 114*b*. The truck 120 has a fluid source 115*b* with a pump for pumping fluid through the CT 110*b* and the BHA 112*b*. The BHA 112*b* may include various components, for performing measurement, data storage, and/or other functions. Such components may include, for example, well control devices, such as check valves or flapper vales, emergency safety joints, disconnects, jars, and/or other components used to perform various CT operations. The BHA 112*b* also includes a non-synchronous oscillation assembly 116*b* for oscillating the downhole CT tool 104*b* as is described further herein.

Figure 2A:
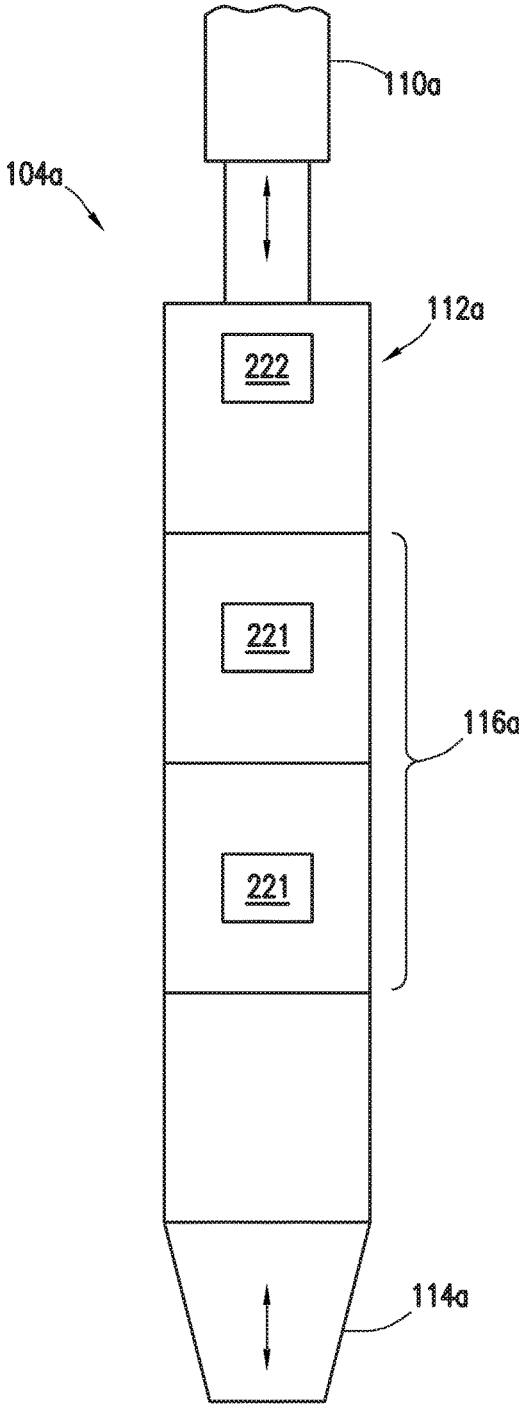
FIGS. 2A-2B are schematic diagrams of the downhole drilling tool of FIG. 1A and the downhole coiled tubing tool of FIG. 1B (or 1C or 1D), respectively.
Figure 2B:
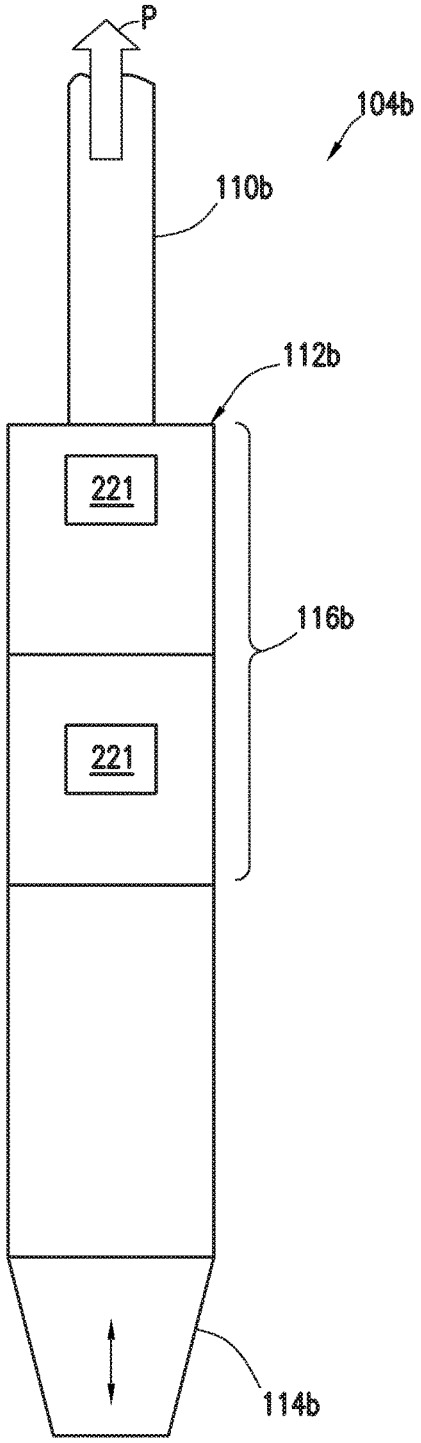

FIGS. 2A and 2B show portions of the downhole tools 104*a,b* of FIGS. 1A and 1B, respectively. FIG. 2A depicts an example configurations of the BHA 112*a* of FIG. 1A including the non-synchronous oscillation assembly 116*a*. FIG. 2B depicts an example configuration of the BHA 112*b* of FIG. 1B including the non-synchronous oscillation assembly 116*b*.

The non-synchronous oscillation assembly 116*a* includes a pair of oscillators 221 positioned in the BHA 112*a*. The oscillators 221 may include spring-loaded members capable of generating oscillating movement that may be used to impact the drill bit 114*a* against the formation during drilling and/or transferring weight to the bit by introducing an axial oscillating motion to keep the drillstring moving. Example oscillators that may be used are disclosed in US Patent/Application No. 2012/0186878, U.S. Pat. Nos. 6,508,317, 6,431,294, previously incorporated by reference herein.

The BHA 112*a* of FIG. 2A as shown may also include other motion devices, such as a shock tool 222 and/or other drill string extender to generate movement of the drill string 110*a*. The shock tool 222 may be connected to the drill string 110*a* to absorb shocks to the downhole tool 104*a*. As shown, the shock tool 222 is a spring-loaded telescoping device that extends and retracts to absorb shocks to the downhole tool 104*a*. The shock tool 222 may also be used to isolate the drill string 110*a* from axial deflections while permitting vertical movement of the downhole tool 104*a* during operation. Examples of shock tools 222 that may be used include the BLACK MAX MECHANICAL SHOCK TOOL™ or a GRIFFITH™ shock tool (e.g., 6¾" (17.14 cm) with a pump open area of 17.7 $in^2$ (43.55 $cm^2$)) commercially available at www.nov.com.

The shock tool 222 and/or the oscillators 221 (alone or in combination) may generate motion in the downhole drilling tool 104*a*, for example, to facilitate movement of the downhole drilling tool 104*a* through the wellbore, to facilitate impact of the drill bit during drilling, and/or to prevent sticking of the downhole tool 104*a* therein.

As shown in FIG. 2B, the BHA 112*b* may include the non-synchronous oscillation assembly 116*b* with the pair of oscillators 221 coupled to the CT 110*b*. In this version, no shock tool is provided, but may optionally be provided. In this configuration, the oscillators 221 (alone or in combination) may generate oscillating motion in the downhole CT tool 104*b*, for example, to facilitate movement of the downhole tool 104*b* through the wellbore, to extend/retract the CT 110*b*, and/or to prevent sticking of the downhole tool 104*b* therein. Such motion may be used, for example, to address the helical and/or sinusoidal coiling of the downhole CT tool 110*b* which may occur as shown in the examples of FIGS. 1B-1D. In particular, the oscillations may be used to selectively restrict flow such that pressure P is increased in the CT 110*b* which may be used to assist in straightening the downhole CT tool 110*b* and/or removing helical and/or sinusoidal coils along the downhole CT tool 110*b*.

Figure 3A:
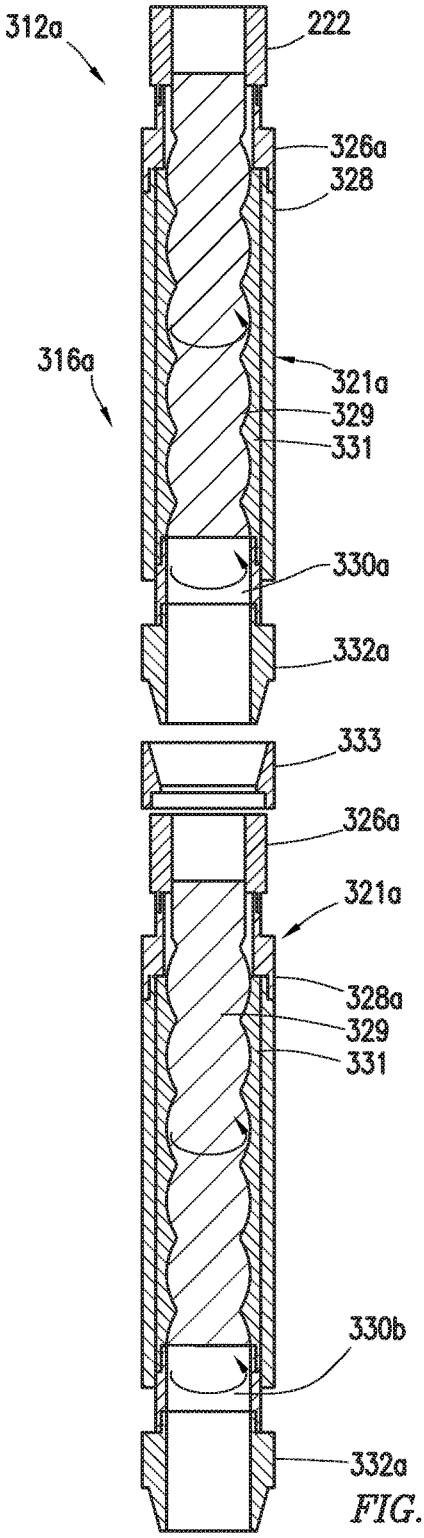
FIGS. 3A-3B are longitudinal, cross-sectional views of alternate versions of the downhole drilling tool in a tandem and dual configuration, respectively.
Figure 3B:
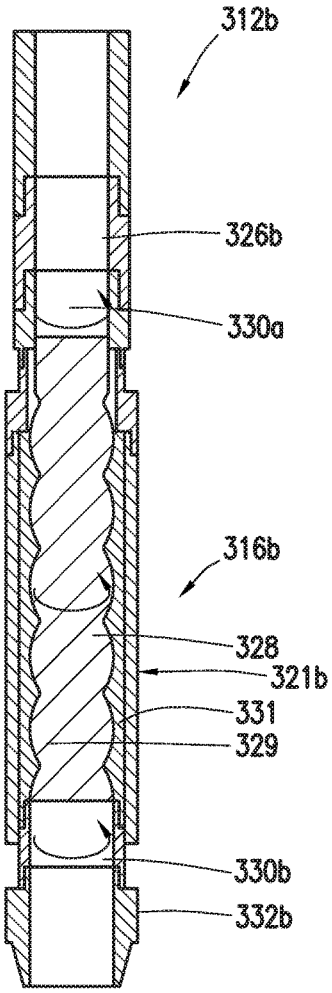
Figure 4A:
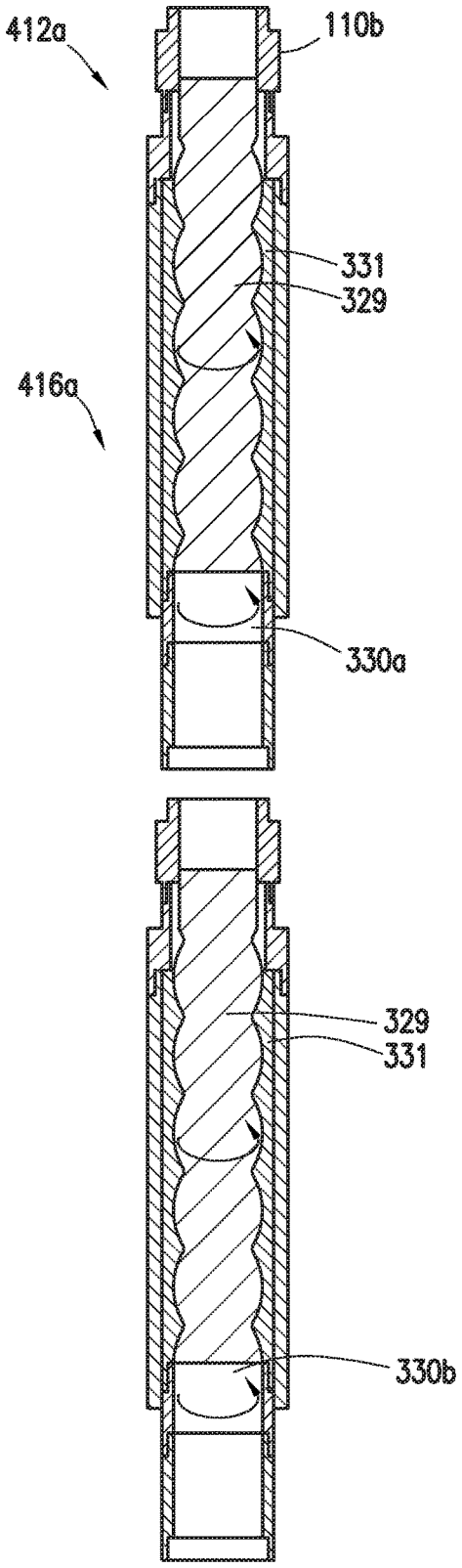
FIGS. 4A-4B are longitudinal, cross-sectional views of alternate versions of the downhole coiled tubing tool in a tandem and dual configuration, respectively.
Figure 4B:
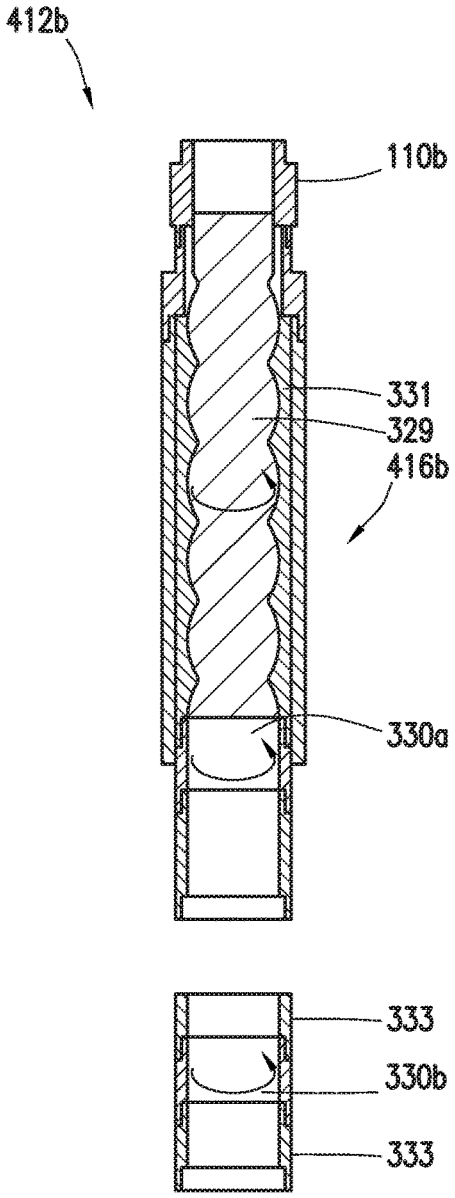
Figure 7A:
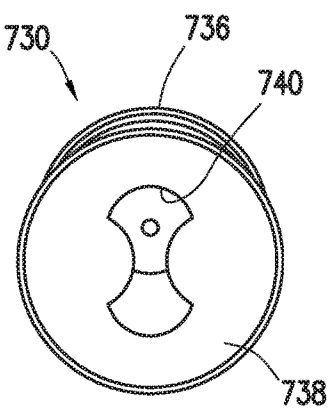
Figure 7B:
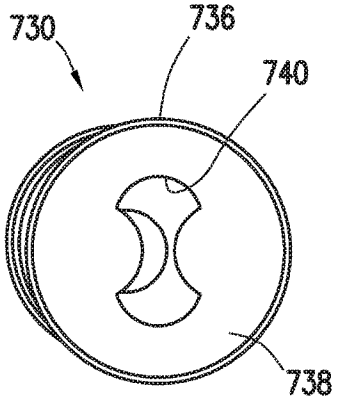
Figure 7C:
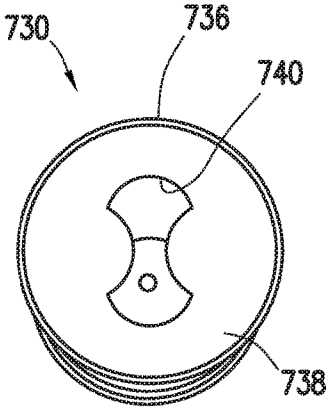
Figure 7D:
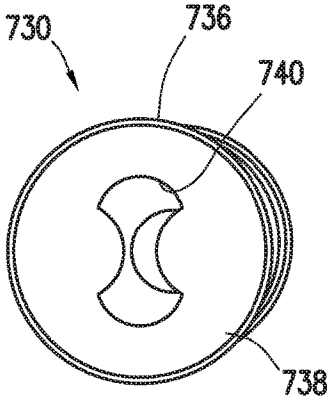
Figure 8A:
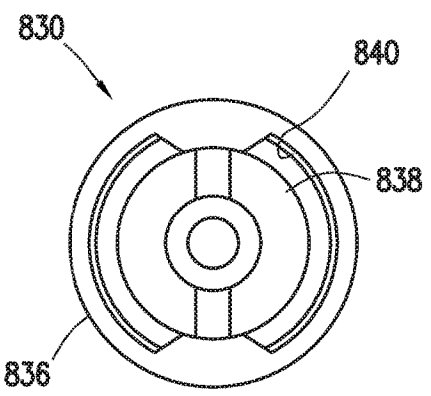
Figure 8B:
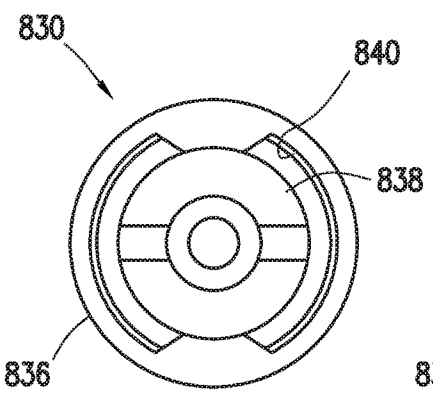
Figure 8C:
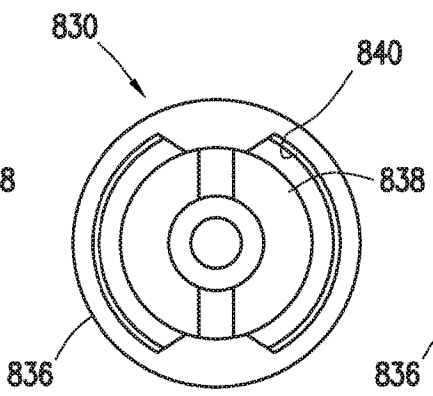
Figure 8D:
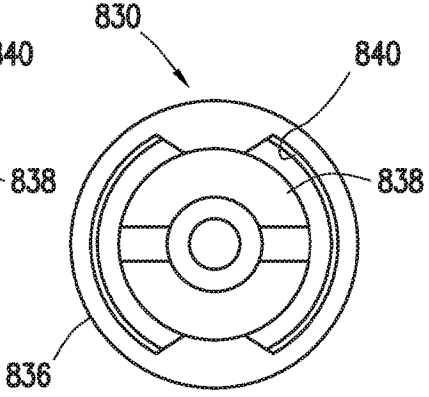

FIGS. 3A-4B show various versions of oscillation assemblies. FIGS. 3A-3B show detailed views of an example BHA 312*a,b* including oscillation assemblies 316*a,b* usable in the downhole tool 104*a* (FIG. 1A) in a tandem and a dual configuration, respectively. FIGS. 4A-4B show detailed views of an example BHA 412*a,b* including oscillation assemblies 416*a,b* usable in the downhole tool 104*b* (FIGS. 1B-1D) in a tandem and a dual configuration, respectively.

In the tandem example of FIG. 3A, the oscillation assembly 316*a* includes a stacked pair of oscillators 321*a*. Each oscillator 321*a* includes a top sub 326*a*, a drive section 328, valves 330*a,b*, and a bottom sub 332*a*. The top sub 326*a* is connectable to the drill string and/or other components of the BHA 312*a*. The bottom sub 332*a* may connect to the top sub 326*a* of an adjacent oscillator 321*a* or other component in the BHA 312*a*. The connections as shown are pin and box type connections connectable to matable drill collars or other devices, but can be any connection.

The drive section 328 may include a motor, turbine or other member capable of driving the valve 330*a*. In the example shown, the drive section 328 is a positive displacement (e.g., Moineau) motor including a rotor 329 and stator 331 rotationally driven by fluid flow. The rotor is coupled to the valve 330*a* for rotationally driving the valve to vary flow therethrough.

The valves 330*a,b* are rotationally driven by the rotor 329 to selectively permit fluid to pass through the BHA 312*a*. The valves 330*a,b* may have ports that fully or partially open and close to control the passage of fluid. Examples of valves and/or rotor/motor driven valves are provided in. US Patent/Application No. 2012/0186878, U.S. Pat. Nos. 6,508,317, 6,431,294, previously incorporated by reference herein. Examples of valves are also shown in FIGS. 5A-8D.

The valves 330*a,b* may be any valve capable of selectively passing fluid through the BHA 312*a* to generate various frequencies as is described further herein. In the example shown, the valves 330*a,b* are different valves capable of generating different fluid flow therethrough. Optionally, valves 330*a,b* may be the same valve operated at different flow rates or otherwise varied to generate the different frequencies therethrough. In an example, the valve 330*a* may be a rotary valve, such as the valve of FIGS. 5A-5D, and the valve 330*b* may be a drum valve, such as the valve of FIG. 8A-8D (or vice versa).

As also shown by FIG. 3A, various optional features may be provided. For example, the pair of oscillators 321*a,b* are joined together by a spacer 333. The uphole end of the upper oscillator 316*a* is connected to a shock tool 222. The uphole end of the assembly 316*a* may be coupled directly to the drill string 110*a* or via components, such as the shock tool 222.

In the dual example of FIG. 3B, the oscillation assembly 316*b* includes integrated oscillator 321*b* with top and bottom subs 326*b*, 332*b*. This example is similar to FIG. 3A, except that only a single drive section is provided with both valves 330*a,b* driven by the rotor 329. In this configuration, valves 330*a,b* are different valves with different ports defining different frequencies when rotated by the same rotor 329.

FIGS. 4A and 4B are similar to FIGS. 3A and 3B, except these versions show the oscillation assemblies 416*a,b* connected to the CT 110*b*. In the tandem configuration of the BHA 412*a* of FIG. 4A, the upper drive assembly 416*a* is connected to the CT 110*b* at an uphole end and to another drive assembly 416*a* at its lower end. No spacer is needed, but optionally may be provided. As shown by this example, the valves 330*a,b* may be the same in both oscillation assemblies 416*a*.

In the integrated example of FIG. 4B, the drive section 328 is uphole of both valves 330*b*. The valves 330*a,b* may be connected to the rotor 329 and driven thereby. The valves 330*a,b* may optionally have one or more spacers 333 as shown. The valves 330*a,b* are depicted as different valves that are rotatable by rotor 329 to generate different frequencies through the BHA 412*b*.

While the embodiments of FIGS. 3A-4B show example configurations of the oscillators, it will be appreciated that the oscillators and/or assemblies may have various configurations. For example, while valves are shown as the mechanism for varying flow through the BHA, other devices capable of varying flow may be used. Additionally, various drivers may be used to drive the valves at various speeds to provide a desired flow rate through the valve. One or more drivers may drive one or more of the valves. Each valve may have its own driver, or use the same driver. The valve may be selected, for example, based on the drive mechanism configuration (e.g., ½ lobe power section versus a multi-lobe power section). Various numbers of valves, oscillators, and/or oscillation assemblies may be provided.

The drivers and/or valves (or other devices) may be used to define the frequencies of pressure pulses through the BHA. The drivers and/or valves may be configured to provide various frequencies and/or amplitudes as is described further therein. Desired frequencies may be selected to achieve desired operation, such as based on the type of tool, geometry of the wellbore, flow rate, and/or valving. Flow into the BHA may be controlled from the surface, for example, by varying mud pumped from the mud pit (FIG. 1).

FIGS. 5A-8D depict various example configurations of valves 530-830 usable in as the valves 330*a,b* of FIGS. 3A-4B, including neo, legacy, modified neo, and drum valves, respectively. Each of the valves 530-830 have variable openings 540-840 therethrough for controlling the amount of flow through the drive section of the oscillator to achieve the desired flow through the BHA and generate desired oscillations. As shown by these examples, various configurations of valves may be used for varying the flow area through the BHA and thereby defining the pressure pulses and oscillations generated thereby.

Each of the valves has a housing 536-836 with the passage 540-840 therethrough, and a cover 538-838 rotatable about the housing 536-838 to selectively cover a portion of the passage 540-840, thereby varying the flow area defined therethrough. The cover 538-838 may be rotatable to selectively block at least a portion of the opening 540-840 to vary the flow. This variation may create pressure pulses through the BHA.

The valves 530-830 each have openings 540-840 that are partially covered by the rotation of the cover 538-838 to cover a portion of the openings 540-840 as it is oscillated therein (e.g., by rotor 329 of FIGS. 3A-4B). The covers 538-838 have openings of various shapes that rotate to selectively align and misalign with openings in the housings 536-836 to vary flow area therethrough, thereby creating pressure pulses. As shown, the openings in the housing and/or the covers may be varied to adjust the amount of flow and the frequency of pulses generated thereby. Openings in the cover and/or housings may be the same or different to provide the desired operation.

The valves may be operated to selectively define the oscillations generated by the oscillation assemblies. The valves may be operated, for example, to provide a desired frequency of oscillation. Various factors, such as type of tool, geometry of the wellbore, flow rate, and/or valving, may apply in determining desired frequencies. The valves may vary flow through the BHA such that oscillations generated by the oscillators of the BHA are different as is described further herein.

While FIGS. 5A-8D show specific configurations of two-piece valves with varied, but continuous flow through a passage, the valve may have various configurations. For example, the valve may have drums, plates, or other members movable to define one or more orifices for controlling flow therethrough.

Figure 9B:
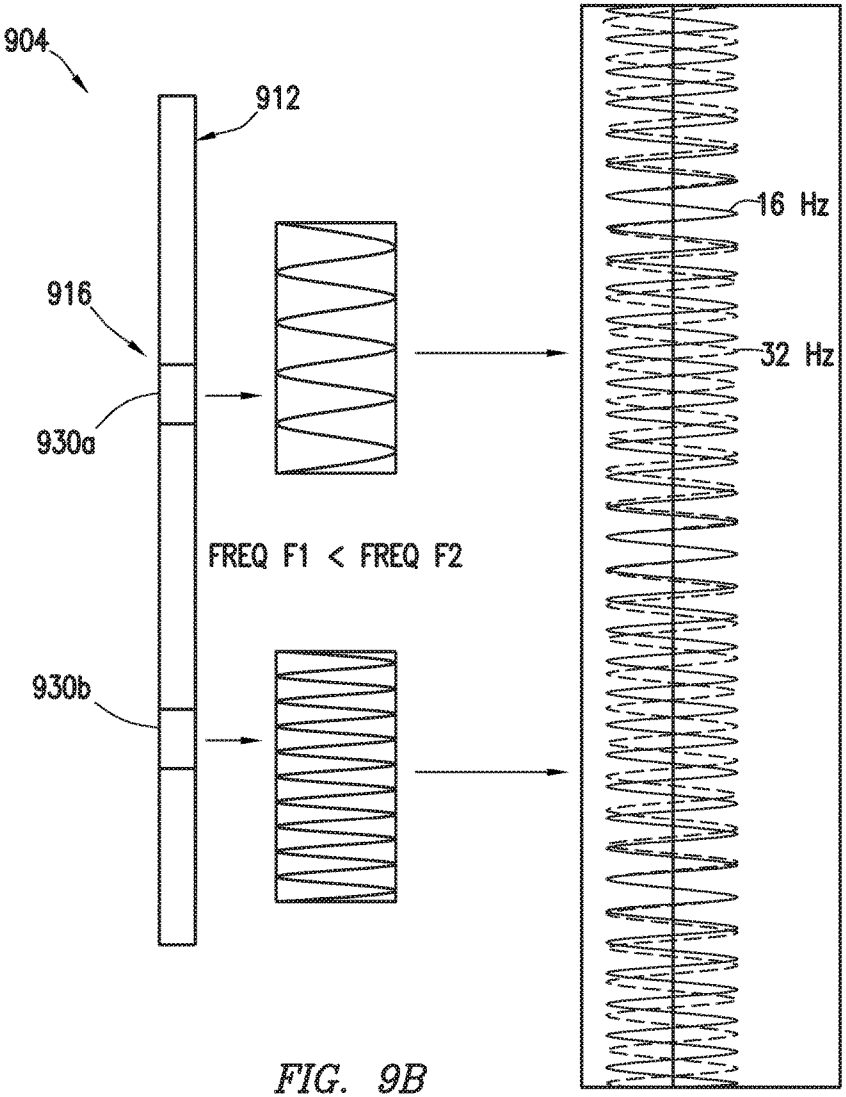
FIGS. 9A-9B are schematic diagrams of the oscillation assembly comprising dual oscillators having synchronous and non-synchronous frequencies.
Figure 9A:
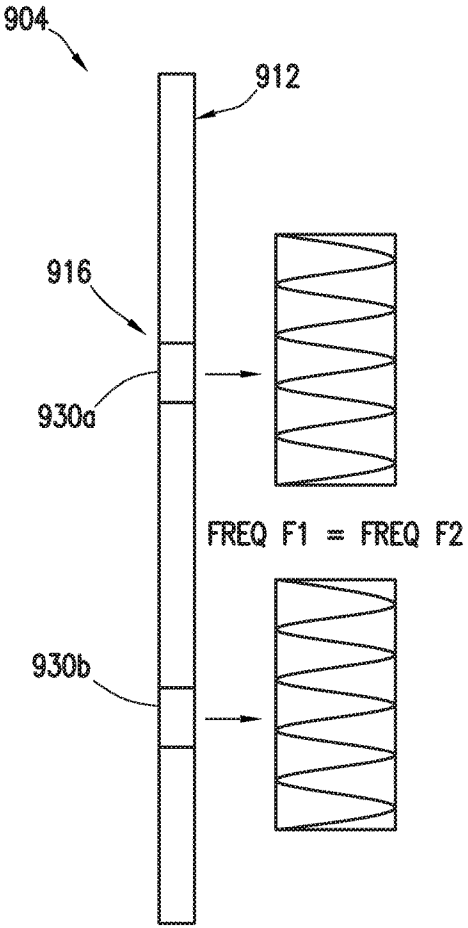

FIGS. 9A-9B are schematic diagrams depicting a BHA 912 of a downhole tool 904, and corresponding frequencies generated by the oscillation assemblies 916 therein, which may be similar to the downhole tools, BHAs, and/or oscillators provided herein. The downhole tool 904 includes two valves 930*a,b*, with each generating a frequency F1, F2, respectively. The valves 930*a,b* may vary between the synchronous and non-synchronous modes to achieve the desired operation to facilitate movement of the downhole tool through the wellbore. The valves may be the same or different, and selected and/or operated to vary flow rate through the oscillators to generate the desired frequencies.

As shown, the valves 930*a,b* may be operated in unison as shown in FIG. 9A to generate equal (synchronous) frequencies F1=F2 as depicted by the graphs. As shown in FIG. 9B, the valves 930*a,b* may be operated irregularly to generate unequal (non-synchronous) frequencies F1<F2 as depicted by the graphs. In this version, the frequency F2 of the downhole valve 930*b* has been varied to be different from that of the uphole valve 930*a*. This may be accomplished, for example, by changing the operation of the valve and/or driver of one or both of the oscillation assembly 916.

As further shown in FIG. 9B, non-synchronous operation of the valves 930*a,b* may lead to a combined, irregular frequency F1+F2. The frequencies F1, F2 interact to generate oscillations that have higher and lower periods with varying amounts of overlap. The dual frequencies may combine to cause harmonics of the frequencies to move in and out of phase, to move into and/or out of sequence, and/or to sweep through a frequency range. Such varying frequencies may be used to yield resonant excitation as the downhole tool 904 moves through the wellbore.

Figure 10A:
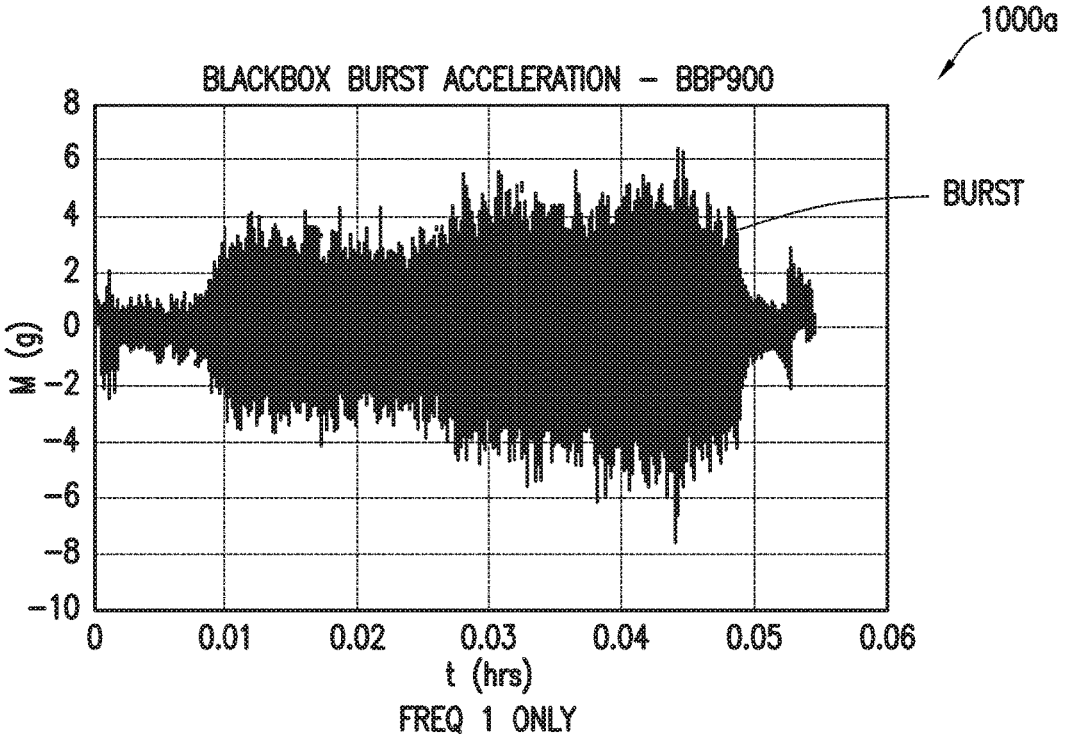
FIG. 10A shows a burst generated using a single valve.
Figure 10B:
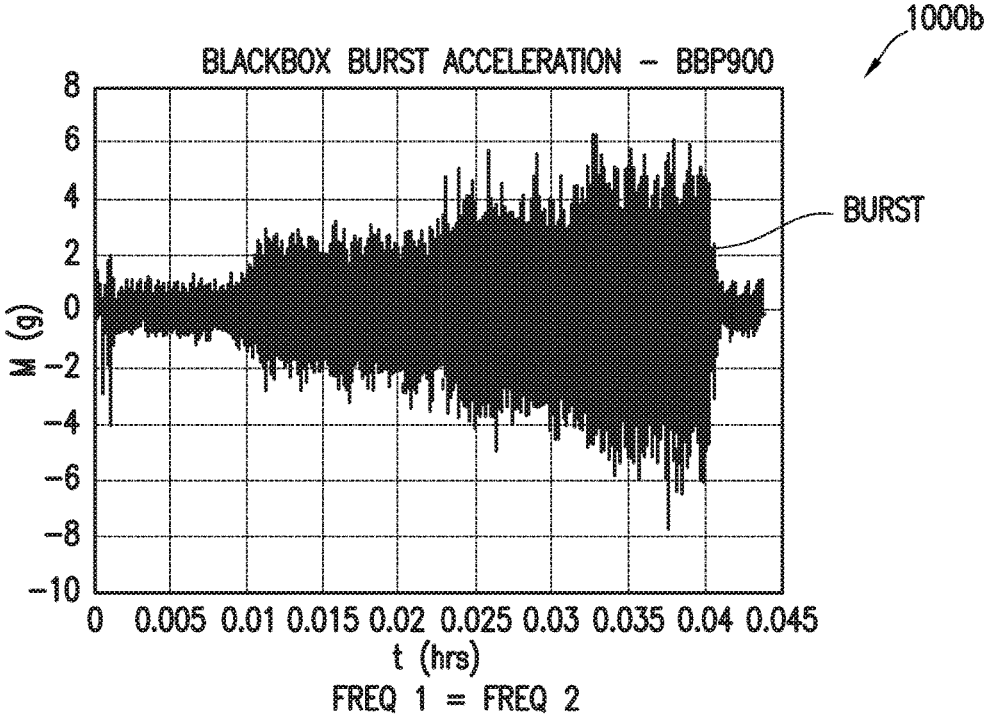
FIG. 10B shows a burst generated using two valves operating synchronously.
Figure 10C:
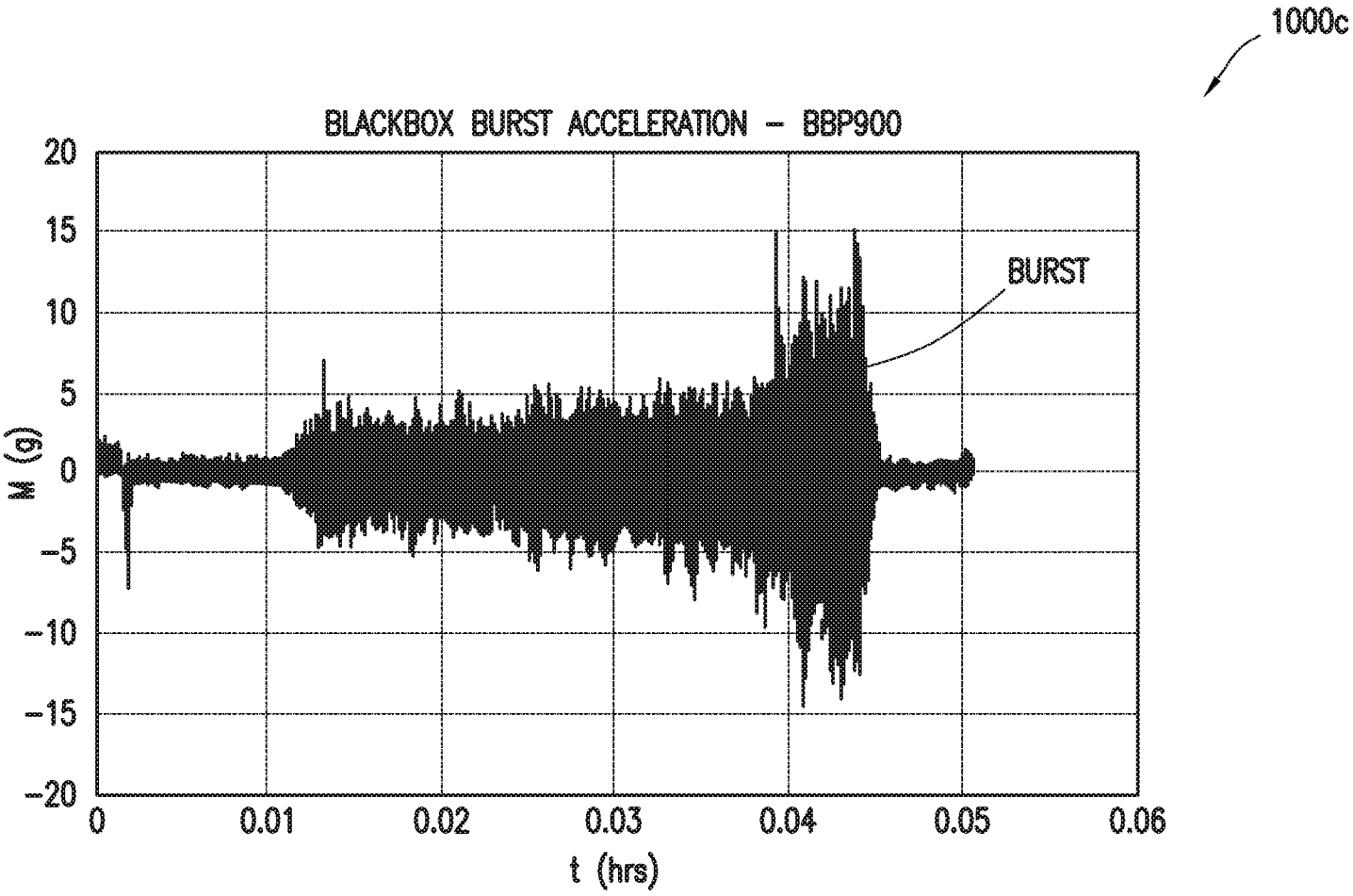
FIG. 10C shows a burst generated using two valves operating non-synchronously.

FIGS. 10A-10C are graphs 1000*a-c* depicting examples of bursts generated by various operation modes of the oscillation assembly. The graphs 1000*a-c* plot magnitude M (y-axis) versus time t (x-axis) for each mode including synchronous, out of phase, and non-synchronous, respectively. FIG. 10A shows a baseline case depicting the burst acceleration when the BHA is operated using a single valve. As shown by this graph, the burst generated by the oscillation assembly has a large magnitude (about +/−6 to about +/−8) over most of the duration.

FIG. 10B shows the burst acceleration when the BHA is in a synchronous mode with two valves operating in unison (see, e.g., FIG. 9A). As shown by this graph, the burst generated by the oscillation assembly has an increasing magnitude over most of the duration. This graph yields similar burst magnitude (about +/−7 to about negative +/−8) to that of FIG. 10A.

FIG. 10C shows the burst acceleration when the BHA in a non-synchronous mode with two valves operates to generate different frequencies (see, e.g., FIG. 9B). As shown by this graph, the burst generated by the oscillation assembly has a stepped magnitude that is low for a portion of the duration and then increases (about +/−15 to about negative +/−17). This graph indicates a higher performance generated by the increased magnitude of burst generated by the non-synchronous mode.

Figure 11:
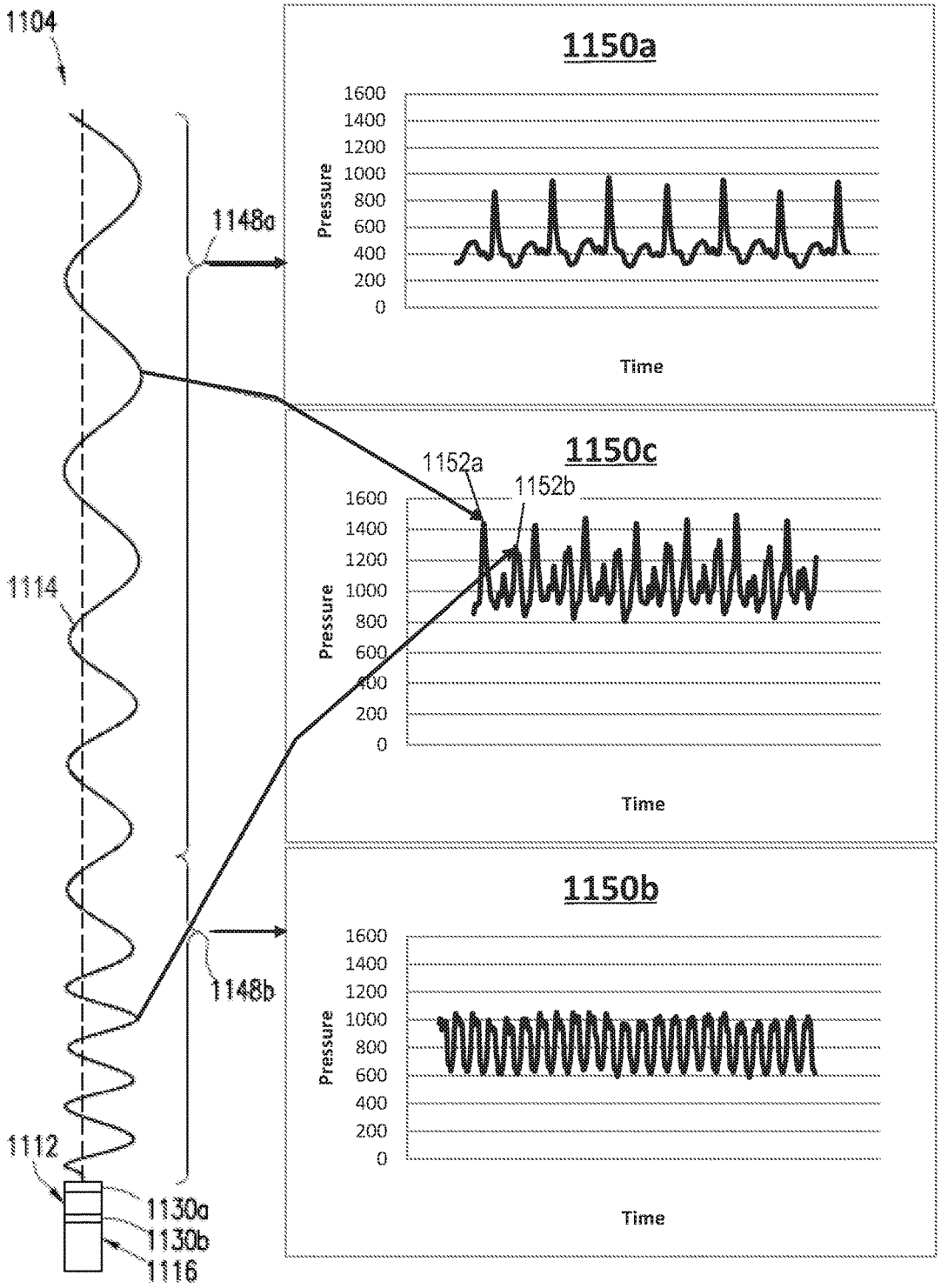
FIG. 11 is a schematic diagram depicting an effect of different frequencies on sinusoidal and helical buckling in the downhole tool.

FIG. 11 is a schematic diagram depicting the effect of nonsynchronous frequencies on a downhole tool 1104 having sinusoidal coiling 1148*a* and helical coiling 1148*b* (see, e.g., FIG. 1D). The downhole tool 1104 includes a BHA 1112 and a tubing string 1114. The tubing string 1114 may include coiled tubing or interconnected drill pipes. The BHA 1112 includes an oscillation assembly 1116 having two valves 1130*a* and 1130*b*. The two valves 1130*a* and 1130*b* can be operated at different frequencies to produce pressure pulses in the tubing string at the different frequencies. For example, the valve 1130*a* may be operated at a first frequency and the valve 1130*b* may be operated at a second frequency that is an integer multiple of the first frequency. In one embodiment, the second frequency may be three times the first frequency (e.g., the first frequency the first frequency may be 7 Hertz (Hz) and the second frequency may be 21 Hz). In another embodiment, the second frequency may be five times the first frequency (e.g., the first frequency the first frequency may be 7 Hertz (Hz) and the second frequency may be 35 Hz). In various embodiments, the second frequency may be any multiple of the first frequency.

Operation of the valves 1130*a* and 1130*b* produces pressure pulses in the tubing string 1114. The pressure pulses correspond in frequency to the frequency of operation of the valves 1130*a* and 1130*b*. That is, operation of the valve 1130*a* at a first frequency produces pressure pulses at the first frequency in the tubing string 1114, and operation of the valve 1130*b* at a second frequency produces pressure pulses at the second frequency in the tubing string 1114. In FIG. 11, the valves 1130*a* and 1130*b* are operated such the second frequency is three times the first frequency.

The graphs 1150*a* and 1150*b* show pressure pulses as pressure P (y-axis) versus time t (x-axis) for the valves 1130*a* and 1130*b*. In FIG. 11, the valve 1130*a* generates pressure pulses shown in graph 1150*a*, which may be directed to correction of the sinusoidal bucking 1148*a* of the tubing string 1114, as indicated by the arrow from 1148*a* to graph 1150*a*. Thus, the frequency of the pressure pulses generated by the valve 1130*a* may be selected to correct or mitigate sinusoidal buckling of the tubing string 1114. Similarly, the valve 1130*b* generates pressure pulses shown in graph 1150*b*, which may be directed to correction of the helical coiling 1148*b* of the tubing string 1114, as indicated by the arrow from 1148*b* to graph 1150*b*. Accordingly, the frequency of the pressure pulses generated by the valve 1130*b* may be selected to correct or mitigate helical buckling of the tubing string 1114.

Graph 1150*c* shows the pressure pulses generated by the combination or summation of the pressure pulses of graphs 1150*a* and 1150*b*, i.e., combination of the pressure pulses generated by operation of the valves 1130*a* and 1130*b* at different frequencies. The combined pressure pulses of graph 1150*c* include pulses 1152*a* produced by summation of the peaks of the pressure pulses of graphs 1150*a* and

1150*b*. That is, the peaks 1152*a* occur when peaks of the pressure pulses of graphs 1150*a* and 1150*b* are coincident in time. The peaks 1152*a* are higher in amplitude than the peaks of the pressure pulses of graphs 1150*a* and 1150*b*. The combined pressure pulses of graph 1150*c* also include pulses 1152*b* produced at times when the peaks of the pressure pulses of graphs 1150*a* and 1150*b* are not time coincident. The pulses 1152*a*, which occur at the frequency of the pressure pulses in graph 1150*a*, may be effective for correcting or mitigating sinusoidal buckling of the tubing string 1114, as indicated by an arrow extending from the tubing string 1114 to one of the pressure pulses 1152*a*. The pulses 1152*b*, which occur at the frequency of the pressure pulses in graph 1150*b*, may be effective for correcting or mitigating helical buckling of the tubing string 1114, as indicated by an arrow extending from the tubing string 1114 to one of the pressure pulses 1152*b*.

Figure 12:
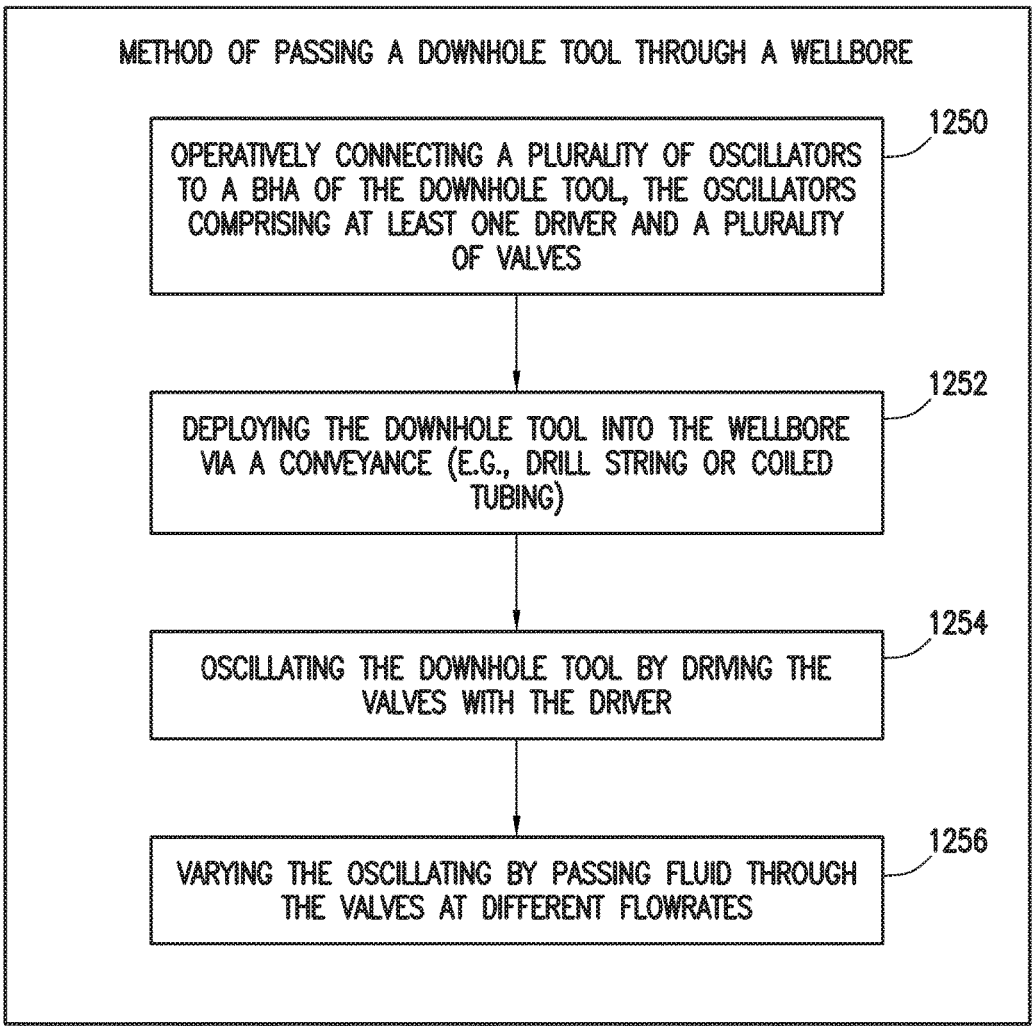
FIG. 12 is a flow chart of a method of passing a downhole tool through a wellbore.

FIG. 12 is a flow chart depicting a method of passing a downhole tool through a wellbore penetrating a subterranean formation. The method involves 1250—operatively connecting a plurality of oscillators to a BHA of the downhole tool. The oscillators comprise at least one driver (e.g., 321*a,b* of FIGS. 3A-4B) and a plurality of valves (e.g., 330*a*-830 of FIGS. 3A-8). The method also involves 1252—deploying the downhole tool into the wellbore via a conveyance (e.g., drill string or CT), 1254—oscillating the downhole tool by driving the valves with the driver; and 1256—varying the oscillating by passing fluid through the valves to generate different frequencies.

The method may be performed in any order and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, various combinations of part or all of the techniques described herein may be performed.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. Apparatus for drilling a wellbore, comprising:

a tubing string; and a bottom hole assembly coupled to the tubing string, the bottom hole assembly comprising:

a first oscillator configured to restrict fluid flow and induce pressure pulses in the tubing string at a first frequency; and a second oscillator configured to restrict fluid flow and induce pressure pulses in the tubing string at a second frequency;

wherein the first frequency is different from the second frequency; and wherein the first frequency is selected to induce pressure pulses in the tubing string to correct helical buckling of the tubing string and the second frequency is selected to induce pressure pulses in the tubing string to correct sinusoidal buckling of the tubing string.

2. The apparatus of claim 1, wherein the first frequency is an integer multiple of the second frequency.

3. The apparatus of claim 1, wherein the first frequency is three times the second frequency.

4. The apparatus of claim 1, wherein the first frequency is five times the second frequency.

5. The apparatus of claim 1, wherein the first oscillator is configured to restrict the fluid flow in the tubing string over a range of frequencies starting at an initial frequency and ending at a final frequency.

6. The apparatus of claim 1, wherein the tubing string comprises coiled tubing or a plurality of drill pipes.

7. The apparatus of claim 1, wherein the first oscillator comprises a first valve configured to open and close to restrict the fluid flow in the tubing string and the second oscillator comprises a second valve configured to open and close to restrict the fluid flow in the tubing string; wherein the bottom hole assembly comprises a rotor coupled to the first valve and the second valve to induce opening and closing of the first valve and the second valve.

8. The apparatus of claim 1 wherein the first frequency is reselected to induce pressure pulses in the tubing string to prevent sticking of the tubing string or the bottom hole assembly to drilling mud in the wellbore and the second frequency is reselected to induce pressure pulses in the tubing string to prevent sticking of the tubing string or the bottom hole assembly to the wellbore.

9. A method, comprising:

arranging a first oscillator and a second oscillator in a bottom hole assembly;

positioning the bottom hole assembly in a wellbore via a tubing string coupled to the bottom hole assembly;

inducing pressure pulses of a first frequency in the tubing string by operating the first oscillator;

inducing pressure pulses of a second frequency in the tubing string by operating the second oscillator;

selecting the first frequency to induce pressure pulses in the tubing string to correct helical buckling of the tubing string; and selecting the second frequency to induce pressure pulses in the tubing string to correct sinusoidal buckling of the tubing string;

wherein the first frequency is different from the second frequency.

10. The method of claim 9, wherein the first frequency is an integer multiple of the second frequency.

11. The method of claim 9, wherein the first frequency is a three times or five times the second frequency.

12. The method of claim 9, wherein the first oscillator is configured to restrict the fluid flow in the tubing string over a range of frequencies starting at an initial frequency and ending at a final frequency.

13. The method of claim 9, wherein the tubing string comprises coiled tubing or a plurality of drill pipes.

14. The method of claim 9, further comprising restricting fluid flow in the tubing string, by the first oscillator, over a range of frequencies starting at an initial frequency and ending at a final frequency.

15. The method of claim 9, further comprising:

opening and closing a first valve of the first oscillator to restrict the fluid flow in the tubing string and opening and closing a second valve in the second oscillator to restrict the fluid flow in the tubing string;

rotating a rotor coupled to the first valve and the second valve to induce opening and closing of the first valve and the second valve.

16. The method of claim 9 further comprising:

reselecting the first frequency to induce pressure pulses in the tubing string to prevent sticking of the tubing string or the bottom hole assembly to drilling mud in the wellbore; and reselecting the second frequency to induce pressure pulses in the tubing string to prevent sticking of the tubing string or the bottom hole assembly to the wellbore.

17. An oscillation assembly for use in drilling a wellbore, comprising:

a first oscillator configured to restrict fluid flow in a tubing string at a first frequency, the first oscillator comprising a first valve configured to open and close to restrict the fluid flow in the tubing string at the first frequency; and a second oscillator configured to restrict fluid flow in the tubing string at a second frequency, the second oscillator comprising a second valve configured to open and close to restrict the fluid flow in the tubing string at the second frequency;

a rotor coupled to the first valve and the second valve to induce opening and closing of the first valve at the first frequency and the second valve at the second frequency;

wherein the first frequency is different from the second frequency.

18. The oscillation assembly of claim 17, wherein the first frequency is an integer multiple of the second frequency.

19. The oscillation assembly of claim 17, wherein the first three times or five times the second frequency.

20. The oscillation assembly of claim 17, wherein the first frequency is selected to induce pressure pulses in the tubing string to correct helical buckling of the tubing string and the second frequency is selected to induce pressure pulses in the tubing string to correct sinusoidal buckling of the tubing string.

21. The oscillation assembly of claim 17 wherein the first frequency is selected to induce pressure pulses in the tubing string to prevent sticking of the tubing string or a bottom hole assembly coupled to the tubing string and the second frequency is selected to induce pressure pulses in the tubing string to facilitate impact of a drill bit coupled to the tubing string against a formation.

22. The oscillation assembly of claim 17 wherein the first frequency is selected to induce pressure pulses in the tubing string to prevent sticking of the tubing string or the bottom hole assembly to drilling mud in the wellbore and the second frequency is selected to induce pressure pulses in the tubing string to prevent sticking of the tubing string or the bottom hole assembly to the wellbore.

23. An apparatus for drilling a wellbore, comprising:

a tubing string;

a bottom hole assembly coupled to the tubing string, the bottom hole assembly comprising:

a first oscillator configured to restrict fluid flow and induce pressure pluses in the tubing string at a first frequency; and a second oscillator configured to restrict fluid flow and induce pressure pulses in the tubing string at a second frequency; and a drill bit coupled to a downhole end of the bottom hole assembly;

wherein the first frequency is different from the second frequency; and wherein the first frequency is selected to induce pressure pulses in the tubing string to prevent sticking of the tubing string or the bottom hole assembly and the second frequency is selected to induce pressure pulses in the tubing string to facilitate impact of the drill bit against a formation.

24. A method, comprising:

arranging a first oscillator and a second oscillator in a bottom hole assembly;

positioning the bottom hole assembly in a wellbore via a tubing string coupled to the bottom hole assembly;

inducing pressure pulses of a first frequency in the tubing string by operating the first oscillator;

inducing pressure pulses of a second frequency in the tubing string by operating the second oscillator;

selecting the first frequency to induce pressure pulses in the tubing string to prevent sticking of the tubing string or the bottom hole assembly; and selecting the second frequency to induce pressure pulses in the tubing string to facilitate impact of a drill bit coupled to the bottom hole assembly against a formation;

wherein the first frequency is different from the second frequency.

* * * * *